US007269884B2

(12) United States Patent
Desmond et al.

(10) Patent No.: US 7,269,884 B2
(45) Date of Patent: Sep. 18, 2007

(54) INCINERABLE ARTICLE OF FUNERARY ORNAMENTATION

(75) Inventors: Tony Desmond, Sereilhac (FR); Jean-Bernard Lodey, Chabanais (FR)

(73) Assignee: Emballages S P, Limoges (FR)

( * ) Notice: Subject to any disclaimer, the term of this patent is extended or adjusted under 35 U.S.C. 154(b) by 0 days.

(21) Appl. No.: 11/186,094

(22) Filed: Jul. 21, 2005

(65) Prior Publication Data

US 2006/0016053 A1 Jan. 26, 2006

(30) Foreign Application Priority Data

Jul. 21, 2004 (FR) ..... 04 51606

(51) Int. Cl.
*A61G 17/00* (2006.01)

(52) U.S. Cl. ..... 27/1; 40/124.5

(58) Field of Classification Search ..... 27/1; D99/5; 40/722, 724, 764, 761, 740, 124.5; 229/87.18, 87.19, 116.5, 923; 248/473, 146, 248/371

See application file for complete search history.

(56) References Cited

U.S. PATENT DOCUMENTS 214,105 A * 4/1879 Cole ..... 40/724
910,576 A * 1/1909 Randall ..... 229/125.19
1,256,337 A * 2/1918 Lieber ..... 248/473
1,759,432 A * 5/1930 Brecht ..... 40/763
1,940,328 A * 12/1933 Schrotenboer ..... 229/103
2,072,167 A 3/1937 Graham
2,899,165 A * 8/1959 James ..... 248/188.8
4,949,483 A * 8/1990 Dobson et al. ..... 40/740
5,292,003 A * 3/1994 Baghdassarian ..... 206/575
5,834,073 A 11/1998 Greenblat
5,950,288 A * 9/1999 Bach Lahor ..... 27/1
2003/0066174 A1 4/2003 Groemminger

FOREIGN PATENT DOCUMENTS

JP 10033603 A 2/1998
JP 2000116734 A 4/2000

* cited by examiner

*Primary Examiner*—William L. Miller
(74) *Attorney, Agent, or Firm*—Patterson, Thuente, Skaar & Christensen, P.A.

(57) ABSTRACT

The purpose of the invention is an article of funerary ornamentation, characterized in that it includes a receptacle adapted to receive mementos, which is of a combustible material and is covered by a display layer with personalized themes. In particular, the receptacle is composed of a box in two parts that enclose each other and the ornamental article includes a supporting device suitable for keeping the box in an inclined plane in relation to horizontal.

12 Claims, 3 Drawing Sheets

INCINERABLE ARTICLE OF FUNERARY ORNAMENTATION

RELATED APPLICATION

This application claims priority to French Application No. 04 51606 filed Jul. 21, 2004.

TECHNICAL FIELD

This invention concerns an incinerable article of funerary ornamentation.

BACKGROUND ART

Participants in funeral ceremonies who wish to honor the deceased make use in burial ceremonies of plaques of stone, such as marble, or other commemorative articles on which inscriptions are engraved in memory of the deceased on which photos or funeral articles, such as crosses or flowers sculpted in metal or other materials, are placed. Such commemorative articles are left around the casket of the deceased and are then left on the grave of the deceased or in the burial vault into which the deceased is placed.

In funeral ceremonies followed by cremation, traditional commemorative articles cannot be used as they cannot accompany the coffin and the deceased at the time of cremation.

SUMMARY OF THE INVENTION

This invention concerns funerary ornamentation articles that have the appearance of traditional, solid funerary articles such as stone plaques, but which are suitable for accompanying the deceased and being incinerated with the deceased.

This invention concerns an article of funerary ornamentation suitable for containing articles such as tokens of esteem, remembrances such as photos, or writings meant to accompany the deceased.

For this purpose, this invention principally concerns an article of funerary ornamentation characterized in that it includes a receptacle, made of combustible material and covered by a layer that showcases personalized themes, suitable for containing mementos.

For its placement at the time of the ceremony, the ornamental article according to the invention includes, in particular, a box in two parts, one enclosing the other, and a supporting device suitable for holding the box in a plane inclined in relation to the horizontal.

More particularly, the ornamental article forms a receptacle for remembrances or mementos, and the first part of the box includes a cover and four first sides, the second part of the box includes a bottom and four second sides, and the four first sides enclose the four second sides.

In the preferred fabrication protecting against the untimely opening of the box once it has been closed, the four first sides of the cover are sized to meet the bottom edge to edge.

According to one special method of fabrication, the supporting device includes a base of a combustible material equipped with a groove to receive an edge or corner of the receptacle.

The groove is advantageously extended in the base by retaining sides of the receptacle, which are inclined in relation to the horizontal.

More particularly, the base itself is formed of a box in two parts, one enclosing the other, and sized so that it can be stored within the receptacle prior to use.

In an alternative fabrication method, the supporting device includes a supporting leg equipped with an articulated end that is connected to the bottom of the receptacle and a free end for support on the surface holding the receptacle.

The display layer may, in particular, have the appearance of a mineral material, and may be a printable covering paper.

Other characteristics and advantages of the invention will be understood better when reading the following description of an example of the invention, but not limited to this example, in reference to the figures.

DETAILED DESCRIPTION OF THE DRAWINGS

Figure 1A:
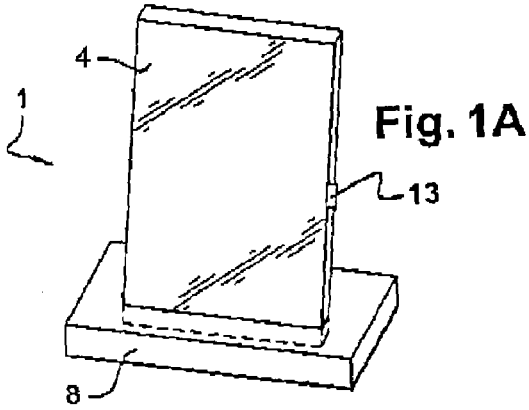
FIGS. 1A, 1B, 1C are perspective views of three examples of a first method of fabricating the invention.
Figure 1B:
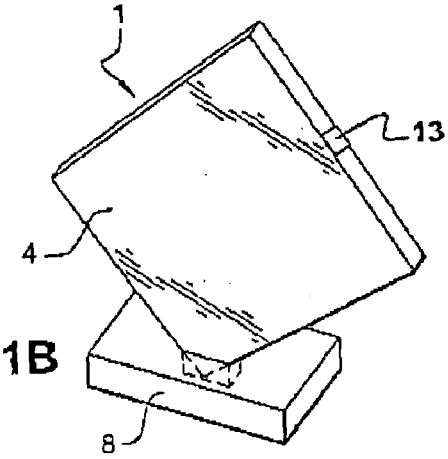
Figure 1C:
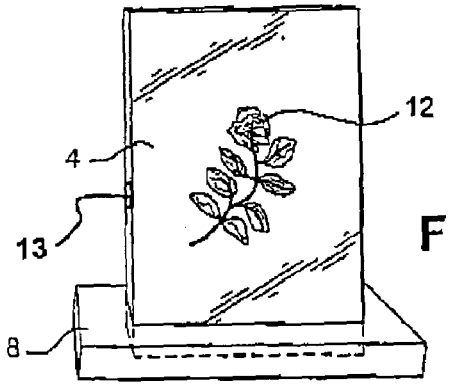

FIGS. 1A, 1B, and 1C represent a first example of making the funerary ornamentation article 1 and 2 according to the invention. This article is meant to contain the remembrances or mementos intended to accompany the deceased and, for this purpose, includes receptacle 3 and 4, suitable for containing the mementos.

Figure 4:
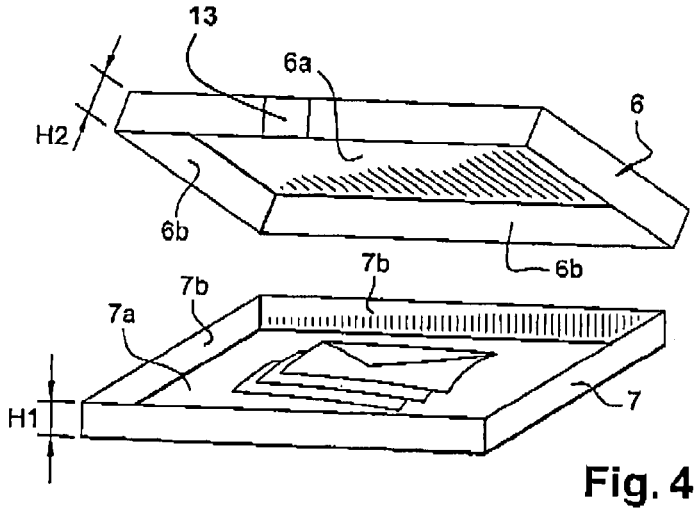
FIG. 4 is a perspective view of a receptacle according to the example of FIG. 1A.

The receptacle 3 or 4 is shown open in FIG. 4, and is composed of a box in two parts, one enclosing the other, 6 and 7. The first part 6 of the box includes a cover 6*a* and four first sides 6*b*, the second part of the box includes a bottom 7*a* and four second sides 7*b*, and the four first sides 6*b* enclose the four second sides 7*b* to close the box and conceal the remembrances or mementos contained inside the receptacle.

To prevent accidental opening of the box once the box is closed, the four first sides 6*b* are sized to meet the bottom 7*a* edge to edge, thus giving the interior height of the first four sides a height H2 that is equal to the outside height of the four second sides.

This arrangement also makes it difficult for any attempt at impropriety by a third party who wants to open the box.

In addition, the receptacle can also include means such as fastening points 13 to enhance the confidentiality of the contents.

The article according to the invention is meant to be placed on the coffin of the deceased or on a support surface around the coffin. To enable the display of the ornamental article, the article includes a support device 8 and 10 suitable for keeping the box in a plane that is inclined in relation to the horizontal.

Figure 2A:
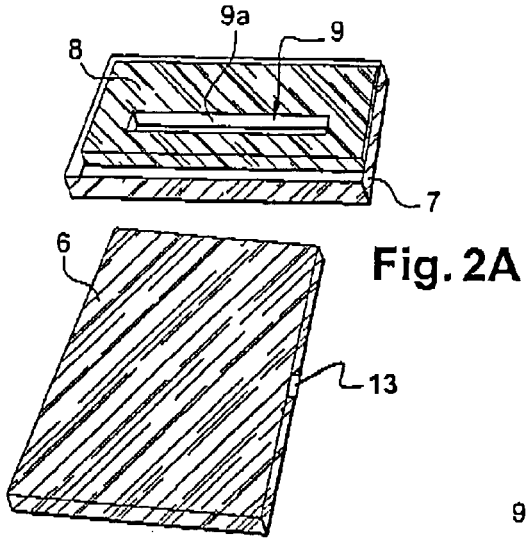
FIGS. 2A and 2B are perspective views of the example of making the invention according to FIG. 1A during assembly.
Figure 2B:
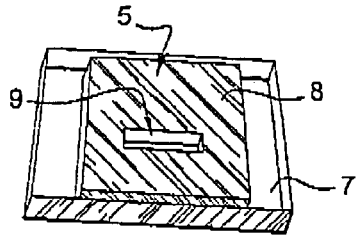
Figure 3:
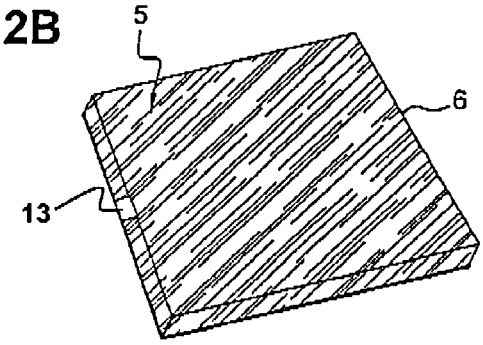
FIG. 3 is a perspective view of a supporting device in the first method of fabricating the invention.
Figure 3:
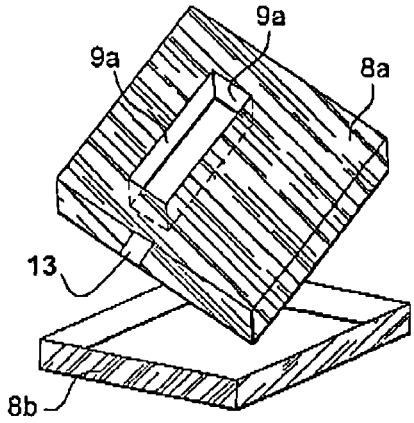

According to the examples of FIGS. 1 to 3, the supporting device includes a base 8 of a combustible material equipped with a groove 9 to accept an edge of the receptacle 3 as shown in FIGS. 1A and 1C or a corner of receptacle 3 as shown in FIG. 1B.

Multiple dimensions are possible and multiple inclines or positions can be created according to the method of fabricating the invention.

According to FIG. 3, the groove 9 in the base is extended by retaining sides 9*a* of receptacle 3, which is inclined in relation to horizontal; position allows display of the receptacle on which a personalized inscription in remembrance or theme 12 is imprinted.

Base 8 is itself composed of a box in two parts 8*a* and 8*b*, which enclose each other, and they are preferably sized so that they can be stored prior to use within receptacle 3. In particular, the height of the sides of the base may be slightly greater than the height H1 so as to allow easy opening of the receptacle in order to remove the base.

Figure 5:
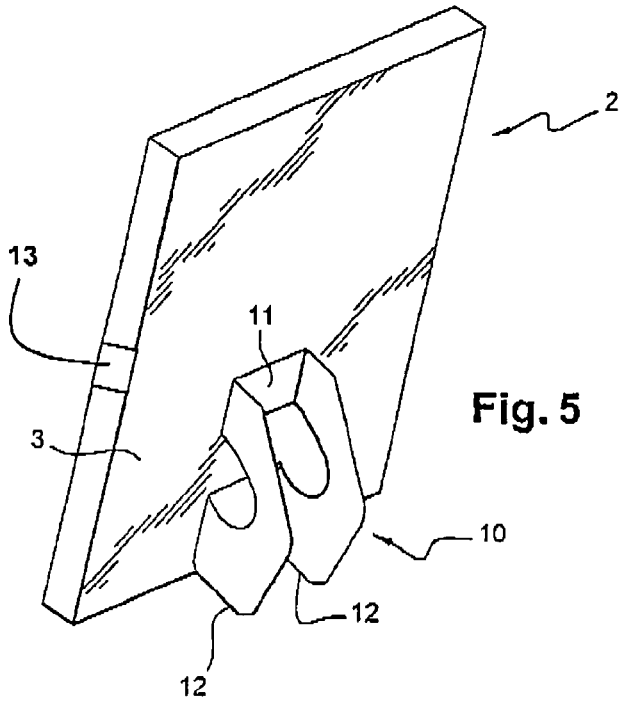
FIG. 5 is a perspective, rear view of a second method for fabricating the invention.

An alternative method for fabricating the supporting device is shown in FIG. 5, according to which the supporting device includes at least one supporting leg 10 (two are shown in the example), equipped with an articulated side 11 on the bottom of the receptacle. In particular, this leg can be equipped with a free side 12 providing support on the receiving surface the coffin, or a support for the coffin.

In the example shown, the two supporting legs 11 are folded perpendicularly at the bottom and keep the receptacle at an angle that is close to vertical.

One of the characteristics of the ornamental article according to the invention is that it is made of a combustible material that, if possible, does not release or releases very few toxic substances when burned and leaves very little residue after combustion. One material that can be used in this context is cardboard. Given the solemnity of the ceremony for which the invention is meant, it is appropriate to give this article a noble appearance and, in particular, to do so, the article is covered in a display layer 5 with personalized themes and, in particular, which has the appearance of a mineral material such as marble or granite.

In particular, the display layer is a sheet of wrapping paper printed with a design reproducing the patterns and veining of the mineral selected and treated to show not only the colors but also the visual appearance, such as the grain and the luminosity of the mineral.

On this display layer, particular designs or words can also be printed or affixed on request, particularly in order to approximate, as closely as possible, a traditional ornamental article of stone would be found in cemeteries.

The invention claimed is:

1. An article of funerary ornamentation comprising:

a receptacle adapted for receiving and containing mementos, the receptacle being made of combustible material and at least partially covered by a display layer with personalized themes, wherein the receptacle is formed of a first box comprising a first box part and a second box part wherein the first box part encloses the second box part; and a support device suitable for keeping the first box at an inclined plane in relation to the horizontal, the support device comprising a base of combustible material with a groove to receive at least part of the receptacle, wherein the base is formed of a second box comprising a first base part and a second base part wherein the first base part encloses the second base part, wherein the support device is capable of being stored within the receptacle.

2. An article of funerary ornamentation according to claim 1, wherein the first box part of the first box comprises a cover and four first sides, and the second box part of the first box comprises a bottom and four second sides, and wherein the four first sides enclose the four second sides.

3. An article of funerary ornamentation according to claim 2, wherein the four first sides are sized to meet the bottom edge to edge.

4. An article of funerary ornamentation according to claim 1, wherein the groove extends in the base creating retaining sides for retaining the receptacle in a position that is inclined in relation to the horizontal.

5. An article of funerary ornamentation according to claim 1, wherein the display layer has the appearance of a mineral material.

6. An article of funerary ornamentation according to claim 1, wherein the display layer is a printed wrapping paper.

7. An article of funerary ornamentation according to claim 1, wherein the receptacle further comprises fastening means adapted to secure the mementos within the first box of the receptacle to enhance confidentiality.

8. An article of funerary ornamentation comprising:

a receptacle adapted for receiving and containing mementos or remembrances, the receptacle being made of combustible material, and at least partially covered by a display layer with personalized themes, wherein the receptacle is formed of a first box comprising:

a first box part comprising a cover and four first sides, and a second box part comprising a bottom and four second sides; and a support device suitable for keeping the first box at an inclined plane in relation to the horizontal, wherein the four first sides of the first part of the first box enclose the four second sides of the second part of the first box so that the first box part encloses the second box part to conceal the mementos or remembrances contained within the receptacle, and wherein the article of funerary ornamentation is adapted to accompany a deceased and be incinerated with the deceased, wherein the supporting device comprises a base of combustible material with a groove to receive an edge or a corner of the receptacle, and wherein the base comprises a second box of at least two base parts, wherein the base parts enclose each other, and wherein the base parts are sufficiently sized to be stored prior to use within the receptacle.

9. An article of funerary ornamentation according to claim 8, wherein the four first sides are sized to substantially align with the bottom edge to edge, making it difficult to open the first box.

10. An article of funerary ornamentation according to claim 8, wherein the groove is extended in the base creating retaining sides for retaining the receptacle in a position that is inclined in relation to the horizontal.

11. An article of funerary ornamentation according to claim 8, wherein the display layer has the appearance of a mineral material.

12. An article of funerary ornamentation according to claim 8, wherein the display layer is a printed wrapping paper.

* * * * *